United States Patent [19]

Frömel et al.

[11] 4,033,507

[45] July 5, 1977

[54] FUEL INJECTION VALVE

[75] Inventors: Gerhard Frömel, Hallstadt; Peter Langenberger, Forchheim, both of Germany

[73] Assignee: Robert Bosch GmbH, Stuttgart, Germany

[22] Filed: Jan. 14, 1976

[21] Appl. No.: 648,481

[30] Foreign Application Priority Data

Jan. 15, 1975 Germany ..... 2501283

[52] U.S. Cl. ..... 239/102; 239/453; 239/574; 239/585

[51] Int. Cl.[2] ..... B05B 1/08; B05B 1/26; B05B 1/32

[58] Field of Search ..... 239/86, 88–91, 239/93–96, 102, 451, 452, 453, 459, 533, 584, 585, 574, 518, 524; 123/32 AE

[56] References Cited

UNITED STATES PATENTS

| | | | |
|---|---|---|---|
| 3,610,529 | 10/1971 | Huber | 239/96 |
| 3,680,794 | 8/1972 | Romann et al. | 239/585 |
| 3,690,566 | 9/1972 | Krauss et al. | 239/453 |
| 3,835,829 | 9/1974 | Links | 123/32 AE X |

FOREIGN PATENTS OR APPLICATIONS

| | | | |
|---|---|---|---|
| 244,894 | 3/1926 | Italy | 239/524 |

*Primary Examiner*—John J. Love
*Assistant Examiner*—Andres Kashnikow
*Attorney, Agent, or Firm*—Edwin E. Greigg

[57] ABSTRACT

A fuel injection valve for an internal combustion engine has a main fuel valve formed by a needle urged against a valve seat by a spring and also includes a solenoid to pull the valve needle away from the seat for fuel metering purposes. In addition, the valve has an extension in which a pestle with two enlarged ends is axially carried in two spring support cups. The enlarged ends of the pestle also act as valves in such a manner that even low fuel-flow causes a fluttering of the pestle, resulting in good fuel atomization.

4 Claims, 1 Drawing Figure

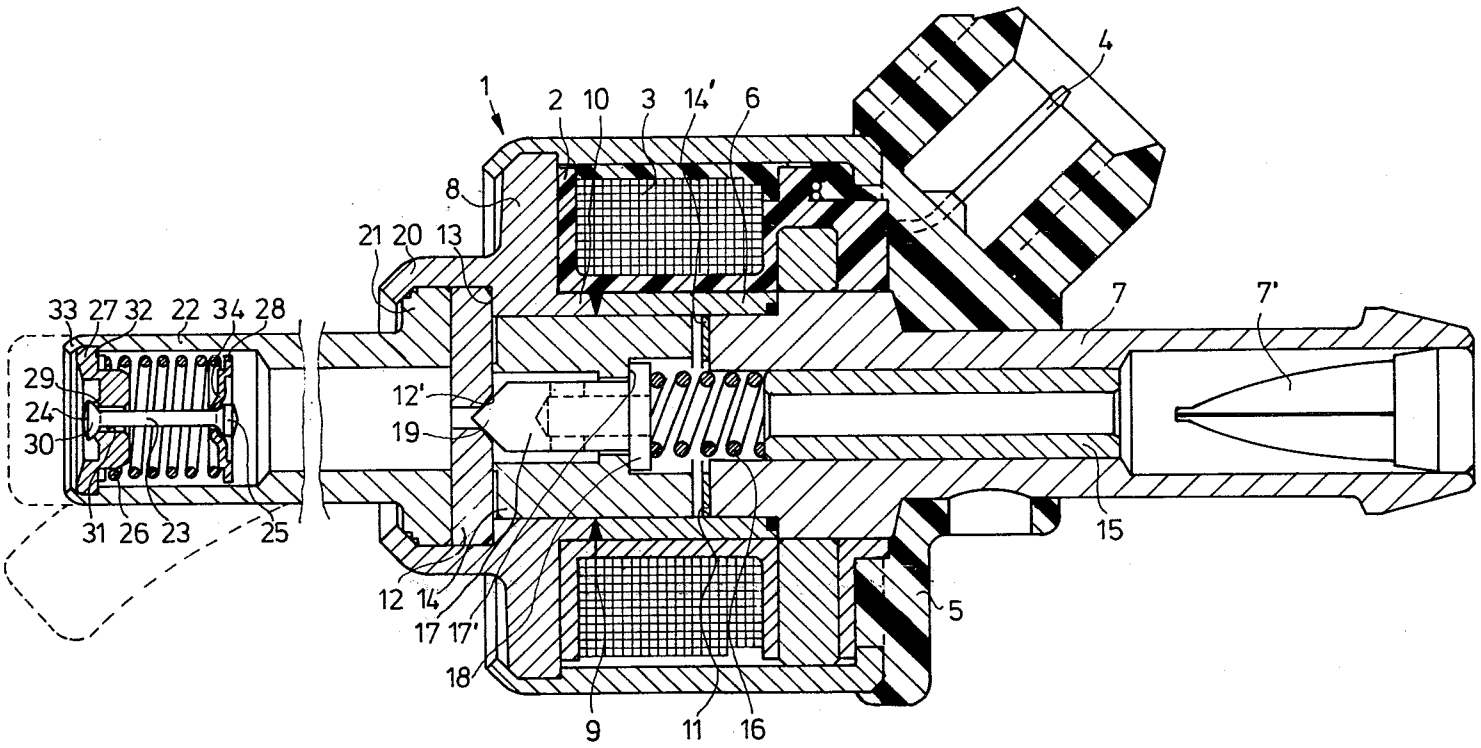
7'
4
7
15
5
6
14'
3
10
2
1
8
13
20
21
12'
19
16
11
9
18
17'
17
14
12
28
34
22
32
27
33
29
24
30
25
23
26
31

FUEL INJECTION VALVE

BACKGROUND OF THE INVENTION

The invention relates to a fuel injection valve for use with timed low pressure fuel injection systems of internal combustion engines. The valve is intended especially for use with fuel injection systems which employ induction tube injection. The valve has a housing in which there is disposed an iron core carrying a fixed magnetic winding. The housing also includes a coaxial armature and a valve needle guided by the armature with clearance. Cooperating with the valve needle is a valve seat located in a disc and the armature, the valve needle, and the valve seat disc together perform the functions of a metering system for fuel. The valve further includes a fuel preparation mechanism.

Injection valves of this type are already known, but suffer from the disadvantage that, when there are residual combustion constituents, the delivered fuel quantity is reduced. To avoid this disadvantage, it has been proposed to use so-called injection cones but these injection cones are sensitive needles which do not permit uniform fuel atomization over extended periods of time.

OBJECT AND SUMMARY OF THE INVENTION

It is a principal object of the invention to provide a fuel injection valve which avoids the disadvantage of irregular fuel supply and permits an exact metering and good preparation of the fuel.

This object is attained, according to the invention, by providing that the fuel preparation mechanism is disposed as a separate unit from the fuel metering mechanism and is located at the fuel delivery end of a connection tube fastened on the valve housing.

It is another object of the invention to provide that the joint which the connection tube makes with the valve housing is permanent and metallic.

Yet another object of the invention provides that the connection tube is to be embodied with different lengths and curvatures so as to conform to specific installation requirements in an engine.

Further objects and advantages will become more apparent and the invention will be better understood from the ensuing detailed specification of a preferred embodiment taken in conjunction with the drawing.

BRIEF DESCRIPTION OF THE DRAWING

The single FIGURE of the drawing is a cross-section through the longitudinal axis of a fuel injection valve according to the invention.

DESCRIPTION OF THE PREFERRED EMBODIMENT

Turning now to FIG. 1, there is seen an injection valve with a valve housing 1 in which is located a coil carrier 2 carrying a magnetic coil 3. The electrical connections to the coil 3 are made via the plastic receptacle ring 5 in which is embedded a plug-in connector 4.

Disposed within the magnetic coil 3 is a nonmagnetic sleeve 6 which is welded or sealed to a connection tube 7 including a filter 7′ and, at the other end, to a housing extension 8. The housing extension 8 has a cylindrical portion 10 whose inside and outside diameters are the same as those of the non-magnetic sleeve 6, thereby permitting a smooth joint.

In the space formed between a face 11 and a valve seat disc 12 carried on an interior shoulder 13 of the housing extension 8, is an armature 14. To prevent sticking of the armature 14 against the tube 7 there is provided a disc 14′. The exterior surface of the armature 14 is guided in a central bore of the members 6 and 8 of the valve housing. Carried within the connection tube is a tubular insert 15 whose one end supports a compression spring 16 which acts on the armature 14. A central bore of the armature 14 carries and guides a valve needle 17 with radial play. The valve needle 17 has a flange 18 intended to cooperate with an inside shoulder 17′ of the armature 14. Normally, the tip 19 of the valve needle 17 makes contact with a conical seating surface 12′ of the perforated valve disc 12. In combination, the armature 14, the valve needle 17 and the valve seat disc 12 form a fuel metering mechanism.

A tubular protrusion 20 of the housing extension 8 is crimped around the valve seat disc 12 and around a flange 21 of a connecting cylinder 22. Depending on the conditions of the intended installation, the connecting cylinder 22 might have different desired lengths and curvatures, as indicated by dashed lines.

The end of the connecting cylinder 22 remote from the valve includes a fuel preparation mechanism. This mechanism consists of a pestle 23 with two enlarged ends 24 and 25, a surrounding compression spring 26 and two valve support cups 27 and 28 which are urged against the enlarged ends 24 and 25 by the spring 26. One of the spring support cups 27 has a lapped valve seat 29 which cooperates with a spherical surface 30 of the enlarged end 24 of the pestle 23. The pestle 24 penetrates the spring support 27 with clearance at an axial penetration 31. The outside rim of the spring support 27 rests on an interior shoulder 32 of the extension cylinder 22 and is clamped there with metal-to-metal seal by crimping of a collar 33. The other spring support 28 is slitted and has a conical profile with a penetration 34, intended to cooperate with the enlarged end 25. All permanent connections and seals of the valve are metal-to-metal seals.

The fuel injection valve described above operates as follows: In the currentless condition, fuel supplied through the connection tube 7 under normal pressure is present at the bore in the valve seat disc 12, obturated by the valve needle 17. When electric current is applied to the coil 3, the armature 14 travels upwardly in the figure and carries the valve needle 7 along against the force of the spring 16. From this point on, filtered fuel can pass into the connecting cylinder 22 through the cross section of the valve 12′, 19, depending on the fuel pressure and the opening time of the valve. Thus precise metering of the fuel takes place independently of external influences.

The fuel thus supplied now reaches the fuel preparation mechanism 23, 26, 27, 28. The fuel opens the valve 29/30 outwardly and the particular suspension of the pestle causes the latter to oscillate even when the fuel throughput is still quit low, and the pestle oscillation causes a very fine atomization of the fuel. In this manner, the fuel precombustion preparation takes place separately from fuel metering. This separation permits an exact metering and yet a clean preparation of the fuel for combusiton. Since the valve 29/30 opens outwardly, combustion remnants cannot result in reduced fuel quantities.

As indicated in the figure by dashed lines, the use of connecting cylinders 22 of different lengths and curvature permits adaptation to different conditions of installation in the vehicle.

What is claimed is:

1. A fuel injection valve for an internal combustion engine, said valve including a housing, and within the housing a coaxial arrangement of an internal solenoid coil, a magnetic core, a movable armature, a valve seat member, and a valve needle carried by said armature and cooperating with the valve seat in said valve seat member for metering fuel past the valve seat member, the improvement comprising:

a connecting cylinder, attached to said valve housing; and a mechanical fuel preparation means, located in said connecting cylinder separately from and downstream of said valve seat member and said valve needle, said connecting cylinder further including a first spring support cup;

a pestle with two enlarged ends, one of said ends penetrating a central hole in said first support cup;

a second spring support cup with a central hole penetrated by the second of said two enlarged ends of said pestle; and a spring, disposed between and urging apart said first and said second spring support cups, thereby pressing them against the enlarged ends of said pestle.

2. A fuel injection valve as defined by claim 1, wherein said connecting cylinder conforms to the geometrical requirements of the internal combustion engine.

3. A fuel injection valve as defined in claim 1, wherein said first spring support cup has a central valve seat cooperating with one enlarged end of said pestle to thereby form a fuel outlet valve and wherein said central hole in said first spring support cap is larger than the diameter of said pestle, thereby permitting penetration with radial clearance.

4. A fuel injection valve as defined by claim 3, wherein said first spring support cup is fixedly positioned in said connecting cylinder.

* * * * *